United States Patent [19]

Howell

[11] Patent Number: 4,723,187

[45] Date of Patent: Feb. 2, 1988

[54] CURRENT COMMUTATION CIRCUIT

[75] Inventor: Edward K. Howell, Simsbury, Conn.

[73] Assignee: General Electric Company, New York, N.Y.

[21] Appl. No.: 929,049

[22] Filed: Nov. 10, 1986

[51] Int. Cl.[4] ..... H01H 9/42

[52] U.S. Cl. ..... 361/13; 361/5; 361/11; 361/57; 361/58

[58] Field of Search ..... 361/5, 6, 8, 9, 10, 361/11, 13, 57, 58; 307/134, 135, 137

[56] References Cited

U.S. PATENT DOCUMENTS

| | | | |
|---|---|---|---|
| 3,588,605 | 6/1971 | Casson | 361/13 |
| 3,809,959 | 5/1974 | Pucher | 317/11 E |
| 3,868,549 | 2/1975 | Schaefer et al. | 317/11 E |
| 4,164,772 | 8/1979 | Hingorani | 361/58 |
| 4,389,691 | 6/1983 | Hancock | 361/6 X |
| 4,420,784 | 12/1983 | Chen et al. | 361/13 X |
| 4,438,472 | 3/1984 | Woodworth | 361/13 |
| 4,475,139 | 10/1984 | Chadwick | 361/56 X |
| 4,550,356 | 10/1985 | Takahashi | 361/13 X |
| 4,583,146 | 10/1986 | Howell | 361/13 |
| 4,631,621 | 12/1986 | Howell | 361/13 X |
| 4,636,907 | 1/1987 | Howell | 361/8 X |
| 4,652,962 | 3/1987 | Howell | 361/5 X |

OTHER PUBLICATIONS

Semiconductors for Power Applications A. I. M. Conference 10–12, Oct. 1983.

*Primary Examiner*—A. D. Pellinen
*Assistant Examiner*—Derek S. Jennings
*Attorney, Agent, or Firm*—Walter C. Bernkopf; Richard A. Menelly; Fred Jacob

[57] ABSTRACT

Load current is diverted from a circuit breaker, when it is opened, through a commutation circuit. The latter has a capacitor, inductance and solid state switch serially connected with the output of a bridge rectifier. The input of the bridge is connected across the breaker. The switch is turned on to discharge the precharged capacitor to form a current pulse, presenting an extremely low resistance across the bridge input and causing load current diversion.

31 Claims, 11 Drawing Figures

Fig. 6. a
2000a
1000a
0
CURRENT (RMS)
I5
I5A
t0 t2 t3 t4 t5 t7

1000a
0
CURRENT (RMS)
I0
t0 t5 t7 t8

1000a
0
CURRENT (RMS)
I02
t1 t5 t7 t8
+Vc
0
-V'c
POTENTIAL (VOLTS)
Vc1
V'c1 t0 t3 t4 t6 t7 t8
TIME INTERVAL

CURRENT COMMUTATION CIRCUIT

The subject invention relates to arrangements for rapidly interrupting load current in a power line interconnecting a source of electric energy and a load and, particularly, for rapidly opening circuit breaking devices with minimal arcing.

BACKGROUND OF THE INVENTION

When load currents of substantial magnitude are interrupted by interrupting devices, such as circuit breakers or switches, large currents, voltages and arcs are produced across the opening contacts of the interruption device. These phenomena are very undesirable. They require utilization of specially constructed massive interruption devices for accommodating the arc voltages and plasma and also require special contact members that are intended to withstand the resulting contact pitting and wear. Nevertheless, contact wear can occur. The described phenomena also introduces substantial current and voltage transients into the power line and load system and substantially increases the time required to complete interruption. Thus, these conventional arrangements are unsatisfactory for some applications.

Alternative interruption, i.e., switching, arrangements have been disclosed for reducing these undesired phenomena and their effects. Generally, they rely upon limiting the current flow through the separating contacts of the interruption device so as to reduce the currents, voltages and the ionization across the opening contacts. Current flow through the opening contacts is reduced by diverting load current from the interruption device to a parallel, i.e., shunt circuit. The shunt path generally includes a device that is switched, i.e., gated on, to divert current from the interruption device. Some arrangements switch on the device upon development of a predetermined arc voltage across the switch. For example, in U.S. Pat. No. 3,809,959-Pucher, the arc voltage attains a value sufficient to break down a spark gap which initiates current diversion. Since diversion is initiated only after the existence of a substantial arc voltage, such systems can not entirely prevent the undesirable consequences of arcing. Arcing is accompanied by production of a plasma, i.e., ionization. The degree of ionization and thus the time required to quench the arc is a function of the arc voltage and current magnitudes. Thus, interruption should occur without substantial arcing.

Some systems have therefore been proposed for diverting load current prior to the existence of substantial arc voltages. In these, the interrupting device is generally shunted by the main electrodes of a switchable solid state device, such as a bipolar transistor, FET or gate turnoff device. The switchable device is turned on by a control signal applied to its control electrode so that the main electrodes shunt the opening contacts of the interrupting device and divert, i.e., bypass, the load current. In some systems, the control signal is initiated prior to the existence of substantial arc voltage to expedite diversion and interruption. The switchable device is then cut off, e.g., by a change of the control signal. The voltage across the diversion circuit, e.g., the switchable device, increases subsequent to cut off, causing a decreasing current flow through the inherent inductance of the system. Current flow continues for some time, since the diversion circuit must essentially dissipate the energy stored in the system inductance and any energy that is still contributed by the source. In some cases, this energy can be entirely dissipated by the switchable solid state device which conducts until current flow terminates. Frequently, however, this energy is at least partially dissipated by a voltage responsive device. For this purpose, a voltage responsive device, such as a varistor, shunts the interruption device, i.e., the switch. The varistor conducts when the voltage across the diversion circuit reaches a predetermined value until current is reduced to zero. Diversion circuits of this type are, for example, disclosed in the following applications and patents which are in the name of E. K. Howell, the subject applicant, and are assigned to the assignee of the subJect application and are herein incorporated by reference: U.S. patent application Ser. No. 874,965 filed June 16, 1986 (which is a Continuation-In-Part of abandoned U.S. Patent application Ser. No. 610,947 filed May 16, 1984) entitled "Solid State Current Limiting Circuit Interrupter"; U.S. Pat. No. 4,631.621 entitled "Gate Turn Off Control Circuit"; and U.S. patent application Ser. No. 681,478 filed Dec. 14, 1984 entitled "Circuit Interrupter Using Arc Commutation".

However, even such systems may not be entirely satisfactory, particularly when load currents of large magnitude are interrupted. Ideally, the contacts of the interrupting device should be opened without any arcing. Current diversion should thus commence, and preferably be complete, prior to opening of the interrupting device. Load current diversion is a function of the ratio between the apparent resistance across that portion of the load circuit that includes the interruption device to the apparent resistance of the diversion circuit that diverts the load current. The contact resistance between the closed contacts of the interruption device is extremely low. For ideal interruption, the diversion circuit should also have an extremely low apparent resistance, i.e., preferably equivalent to a zero ohm shunt. Such an ideal diversion circuit would therefore have substantially no voltage drop while current is diverted. However, diversion circuits of the type described above include one or more serially connected solid state devices which have a finite forward voltage drop across their main electrodes during conduction. Usually, one of th.ese devices is a gated solid state device which is turned on and off by signals applied to a control electrode. Such solid state devices, if of sufficient power capacity and exhibiting sufficient blocking voltage, have a relatively large forward voltage drop during full conduction, i.e., saturation. Thus, the above described diversion circuits may have voltage drops that substantially exceed the voltage across the closed interruption device. This delays load current diversion and thus fails to provide ideal interruption.

Applicant's U.S. Pat. No. 4,636,907 which is assigned to the assignee of the subject application and is herein incorporated by reference, discloses an arrangement for diverting load current prior to opening of the interruption device. It discloses a controlled impedance circuit in series with the interruption device. Responsive to the interruption signal, the impedance value is stepped up from a low value to produce a sufficient voltage drop to fully divert the load current prior to the opening of the interruption device. When used with the above described diversion circuits, a sufficiently high voltage drop must, however, be produced across the impedance to compensate for the voltage drop across the diversion circuit. This may have some undesirable consequences.

For example, the controlled impedance may have to be designed so that load current flow through the controlled impedance produces excessive energy dissipation during normal operation when the interrupting device is closed.

Additional design considerations must also be satisfied for interruption of load currents of large magnitude, particularly if the electric circuit includes substantial inductance. For example, load current diversion must be coordinated so that there is no breakdown of the interruption device (hereinafter also referred to as "switching means") subsequent to its original opening. Also, interruption must occur fast so as to protect against excessive, e.g., short circuit, currents.

OBJECTS OF THE INVENTION

It is an object of this invention to provide an improved interruption arrangement capable of interrupting currents of large magnitude with minimal arcing.

It is a further object to provide such an interruption arrangement that is capable of interrupting a-c and d-c currents.

It is an additional object to provide such current interruption without subsequent breakdown of the interruption device.

It is yet a further object to provide a very rapid interruption of large load currents without producing excessive current or voltage transients.

It is an additional object to accomplish interruption with small electromagnetic interrupting devices.

It is a further object to provide an improved interruption system, capable of utilizing solid state interrupting devices.

SUMMARY OF THE INVENTION

In accordance with one aspect of the invention the circuit interrupter comprises a commutation network of solid state circuit means and of pulse forming means. Responsive to a load current interruption signal, the pulse forming means supplies the network a current pulse having a peak magnitude greater than the load current. The switching means in the power line is connected in circuit with the solid state circuit means so that the load current is diverted through the network in response to the current pulse. The switching means is opened, responsive to the load current interrupting signal, after the current in the network exceeds the value of the load current.

The solid state circuit means is preferably a bridge rectifier having its input terminals connected in circuit with the switching means and its output terminals connected with the pulse forming means. The pulse forming means preferably comprises the series combination of an inductor, capacitor and gated solid state means. In the preferred embodiment, charging means, such as a d-c power supply, precharges the capacitor. The solid state means is gated on by a load current interruption signal to discharge the LC circuit. This produces the current pulse which provides a very low apparent resistance across the input of the bridge rectifier and enables load current diversion.

The current pulse attains a peak amplitude greater than the load current. The current pulse diminishes subsequent to its attaining its peak amplitude. However, the diverted load current continues to flow through the commutation network. This results in a substantial increase of the voltage across the unilaterally conducting means, i.e., the input terminals of the bridge rectifier. It is desirable to utilize voltage control means for limiting the rate of rise of this voltage to prevent breakdown of the switching means. For this purpose, the preferred embodiment utilizes second unilaterally conducting means, i.e., a diode, connected in parallel with the inductor.

The switching means preferably comprises an electromechanical switching device which may be rapidly opened by a signal derived from the network. Alternatively, a solid state switch could be employed such that the voltage decrease across the unilaterally conducting means, e.g., the input terminals of the bridge, commutates the solid state switch off.

BRIEF DESCRIPTION OF THE DRAWINGS

FIG. 6A, FIG. 6B, FIG. 6C, FIG. 6D, FIG. 6E and FIG. 6F are graphic representations of voltage and current waveforms associated with the subject invention.

DETAILED DESCRIPTION OF THE INVENTION

Figure 1:
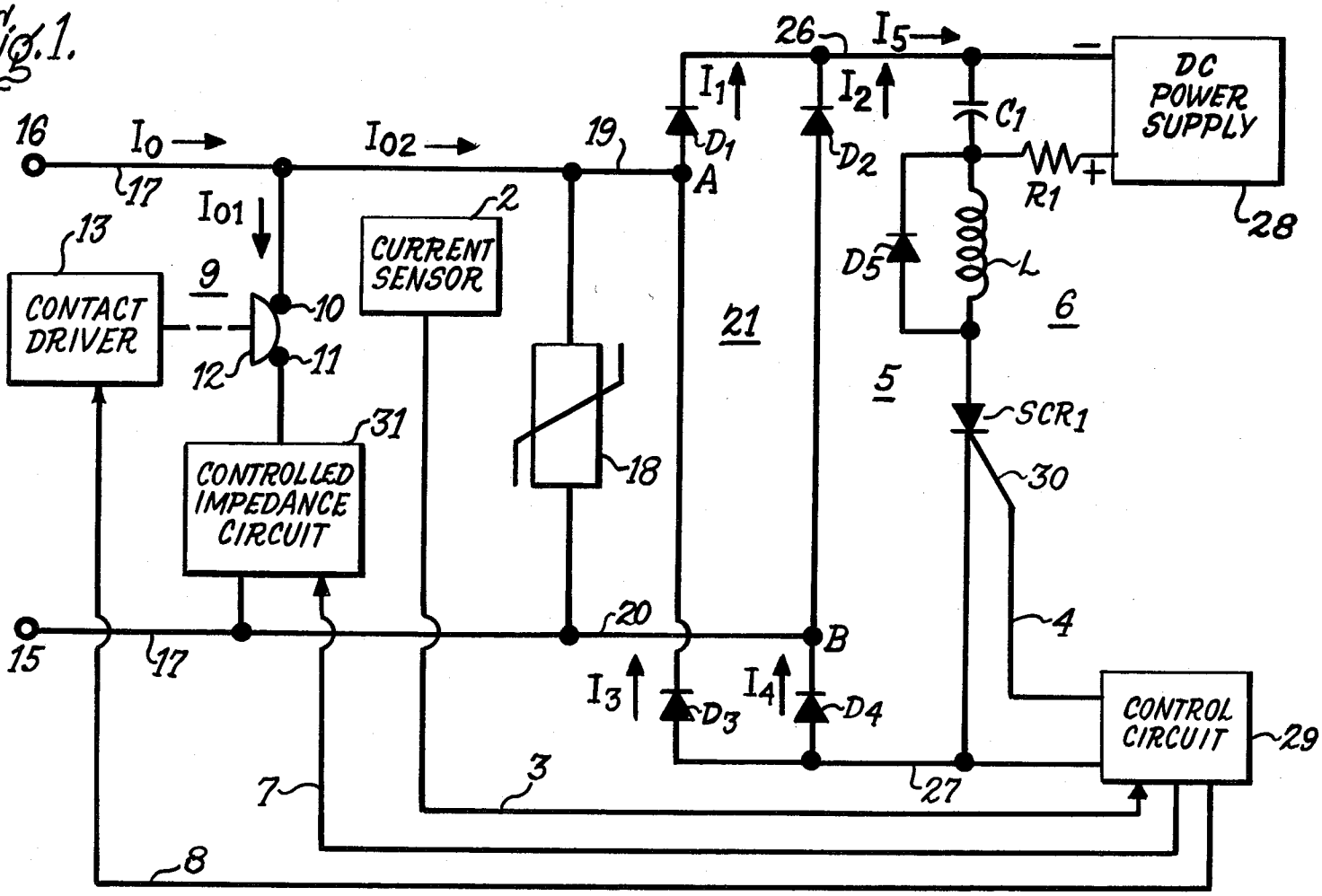
FIG. 1 is a schematic representation of a preferred embodiment of the subject invention.

FIG. 1 illustrates a preferred embodiment of an interruption system capable of interrupting load current flow of substantial magnitude provided by either an alternating or direct current power source. Terminals 15 and 16 are adapted for connection to an external circuit comprising the power source and load. These terminals are interconnected by a series circuit comprising power line 17, switching means, i.e., interruption device 9, and controlled impedance circuit 31. During normal operation, switching means 9 is closed and circuit 31 has substantially no effect on load current flow through power line 17. The contacts of the switching means can be rapidly opened in response to a signal. Preferably, switching means 9 is of the type disclosed in U.S. Pat. No. 4,644,309. This patent entitled "High Speed Contact Driver For Circuit Interruption Device", is in the name of the subject applicant, is assigned to the assignee of the subject application and is incorporated herein by reference. The switching means comprises fixed contacts 10 and 11 and bridging contact 12 arranged across the fixed contacts for providing load current transfer through the power line. Switching means 9 is rapidly opened by displacement of the bridging contact 12 responsive to a current pulse signal. The mechanism for displacing contact 12 is schematically identified as contact driver 13. For purposes of initial explanation, the current pulse signal is supplied to the contact driver from control circuit 29 via line 8. The timing and alternate sources of this current pulse signal are subsequently described.

The controlled impedance circuit 31 is of the type disclosed in U.S. Pat. Ser. No. 4,636,907. This patent, entitled "Arcless Circuit Interrupter", is also in the name of the subject applicant, is assigned to the assignee of the subject application and is also incorporated herein by reference. While the switching means is closed, circuit 31 normally has a negligible impedance value so as not to substantially affect the flow of load current through power line 17. However, when load current flow through the switching means is to be interrupted, the impedance of controlled impedance circuit 31 is increased from a low value to a substantially higher value. Since this occurs prior to opening of the switching means, the load current produces a voltage drop across circuit 31. This diverts the load current to a commutation network which, at the time, has a substantially lower apparent impedance or resistance than that of the controlled impedance 31. Thus, the load current is quickly diverted, i.e., transferred, away from the switch means. This permits the switching means to be subsequently opened with minimal or no arcing. This is explained in referenced U.S. Pat. No. 4,636,907 and in the subsequent description. The control signal for increasing the impedance value of circuit 31 is produced by control circuit 29, in response to a load current interruption command. It is supplied to the controlled impedance circuit by line 7.

A commutation network 5 is connected via lines 19 and 20 across the series circuit comprising switching means 9 and impedance circuit 31. When interruption is commanded, this network shunts this series circuit with an apparent resistance that is extremely low. Load current is thus rapidly diverted through the network. Switching means 9 is opened after the current in the network attains a predetermined value. After a predetermined time, the voltage across the input, lines 19–20, of the network is increased at a controlled rate. The remnant of the load current is then diverted by voltage responsive means 18.

Network 5 comprises pulse forming means 6 and unilaterally conducting means, i.e., bridge rectifier 21. The pulse forming network comprises a series circuit of capacitor $C_1$, inductor L and gated solid state means, i.e., thyristor $SCR_1$. This series circuit is connected to the output of the bridge rectifier 21 via lines 26 and 27. Capacitor $C_1$ is shunted by a charging circuit comprising serially connect d-c power supply 28 and resistor $R_1$. The negative terminal of the power supply is connected to the junction of $C_1$ and line 26 and the positive terminal is connected via $R_1$ to the junction of capacitor $C_1$ and inductor L. The d-c power supply precharges capacitor $C_1$ with a polarity to support subsequent current discharge of the capacitor via the main electrodes of thyristor $SCR_1$ through network 5. Thus, $SCR_1$ has its anode connected to inductor L and its cathode connected to line 27. The control circuit 29 initiates interruption by supplying a gating signal via line 4 to gate electrode 30 of thyristor $SCR_1$. This gates on $SCR_1$ to discharge capacitor $C_1$ through the circuit comprising $C_1$, L, $SCR_1$ and the bridge rectifier 21, thus producing a current pulse in the commutation network as indicated by $I_5$ of FIG. 1.

The bridge rectifier 21 comprises diodes $D_1$–$D_4$. Two serially connected diode pairs, $D_1$–$D_3$ and $D_2$–$D_4$, are each connected across bridge output lines 26 and 27. These diodes are poled to support conduction of the current pulse produced by the pulse forming means. Thus, the anodes of $D_3$ and $D_4$ are connected to bridge output line 27 and the cathodes of $D_1$ and $D_2$ are connected to bridge output line 26. As subsequently described, the current pulse produced by the pulse forming means divides equally between the two parallel diode paths, i.e., $D_1$–$D_3$ and $D_2$–$D_4$. Individual diode currents are indicated in FIG. 1 by $I_{1-I4}$.

The input terminals of the bridge rectifier, A and B, are at the junction of diodes $D_1$ and $D_3$ and at the junction of diodes $D_2$ and $D_4$, respectively. Input terminals A and B are connected via lines 19 and 20 across the serially connected switching means 9 and impedance circuit 31. The division of the current pulse between the parallel diode paths reduces the apparent resistance between input terminals A and B to substantially zero. This, in conjunction with the increased impedance of circuit 31, causes the load current to transfer via input lines 19 and 20 to the commutation network 5. For purpose of explanation, assume that current flows as shown in FIG. 1 at the time load current interruption is commanded: load current in the power line ($I_0$) which flowed through the switching means ($I_{01}$) is now diverted through the commutation network ($I_{02}$). Assuming the indicated direction of current flow, $I_{02}$ flows in the path $D_1$, $C_1$, L, $SCR_1$ and $D_4$. As subsequently described, switching means 9 is opened when the current in the commutation network $I_5$ exceeds the value of the load current $I_0$ and, preferably, when load current is fully diverted, i.e., $I_{02}=I_0$. The apparent resistance, and thus the voltage, across the input lines 19–20, remains extremely low for a predetermined time determined by the parameters of the network, specifically while the current in the commutation network $I_5$ exceeds the diverted current $I_{02}$. Afterwards, the voltage across terminals A-B is automatically increased. With diode $D_5$ connected in parallel with inductor L, capacitor $C_1$ controls the rate of voltage increase to prevent breakdown, i.e., reconduction, of the switching means. A voltage responsive device 18, i.e., a varistor, is connected across lines 19 and 20. When the voltage across terminals A-B increases above the line voltage appearing across the opened switching means 9 and reaches the clamping voltage of device 18, the latter conducts. Device 18 diverts the remnant of the diverted load current from the commutation network and continues conduction until the diverted load current has been fully dissipated.

Load current interruption can be produced automatically in response to an overload current. For this purpose, current sensor 2 provides an indication of the load current magnitude via line 3 to control circuit 29. If the load current exceeds a predetermined threshold magnitude, the control circuit supplies load current interruption signals on lines 4 and 7 to initiate current diversion as described above. A current pulse signal is thereafter supplied on line 8 to open switching means 9. Load current interruption could, of course, be commanded manually, e.g., by a switch input to control circuit 29.

Operation of the commutation circuit is now described in detail. The d-c power supply 28 charges the capacitor $C_1$ to a voltage $V_C$. The polarity is negative at line 26 and positive at the junction of $C_1$ and L. The commutation circuit comprises $C_1$, L, $SCR_1$ and the bridge rectifier ($D_1$–$D_4$) connected in a series loop. Diodes $D_1$–$D_4$ and $SCR_1$ are poled to support conduction of current produced by the capacitor voltage $V_C$. However, no conduction occurs until $SCR_1$ is gated on by a gating signal produced by control circuit 29.

Attention is now directed to FIG. 6, which illustrates waveforms relevant to the operation of the commutation circuit. Circuit interruption is initiated, e.g. responsive to an overload current, by control circuit 29 applying a gating signal to gate electrode 30 of $SCR_1$. This initiates current flow, $I_5$, through the commutation circuit. As shown in FIG. 6a, current $I_5$ increases sinusoidally from zero to a peak value, e.g. 2000 amps during the interval between $t_0$ and $t_3$. The commutation circuit initially operates as a series resonant circuit having a resonance frequency of $$f_0 = \frac{1}{2\pi\sqrt{LC}} \tag{1}$$

The current $I_5$ attains its peak at t=3, a quarter cycle subsequent to its commencement. The interval for the quarter cycle between $t_0$ and $t_3$ thus is $$T/4 = (\pi/2)\sqrt{LC} \tag{2}$$

Current diversion and switch contact opening occurs during this interval between $t_0$ and $t_3$.

Reference is again made to the preferred embodiment of FIG. 1 for an explanation relating to current diversion and switch opening. The above described commutation current, $I_5$, flows in the loop comprising components $C_1$, L, $SCR_1$ and the bridge rectifier circuit 21. The commutation current flows through two parallel paths in the bridge rectifier. These paths comprise, respectively, serially connected diodes $D_1$ and $D_3$, and serially connected diodes $D_2$ and $D_4$. If matched pairs of diodes are used for $D_1$ and $D_2$ and for $D_3$ and $D_4$, the commutation current $I_5$ will divide equally between the two parallel paths. Absent any diverted current $I_{02}$, all diode currents will be equal:

$$I_1 = I_2 = I_3 = I_4 \tag{3}$$

Thus, the commutation circuit presents across its terminals A-B a voltage, $V_{AB}$, and an apparent resistance, $R_{AB}$, that are very close to zero. Load current, $I_0$, (FIG. 6b) then commences to divert from switch 9 to the commutation circuit as shown by diverted current $I_{02}$ in FIG. 6c. Simplistically, current is transferred responsive to the ratio of the resistances between the switch 9, impedance circuit 31 and the apparent resistance between terminals A-B. The apparent resistance, $R_{AB}$, presented at terminals A-B by the commutation circuit is extremely low, e.g., 0.4 milliohms. In fact, it is comparable with, or conceivably even lower than, the contact resistance of closed switch 9. For example, the latter may be in the order of 0.5 milliohms. Thus, current diversion can commence prior to switch opening even without use of impedence circuit 31, i.e., with switch 9 being directly connected via lines 19–20 to terminals A-B. As the switch opens, its contact resistance increases rapidly with respect to the apparent resistance of the commutation circuit. The apparent resistance $R_{AB}$ remains low, i.e., close to zero ohms, during the time interval between $t_0$ and $t_3$ (FIG. 6a), as subsequently explained.

Upon initiation of current diversion at t=0 (FIG. 6a), the current $I_5$ through the commutation circuit consists solely of the current produced by the commutation circuit. An increasing portion of the load current $I_0$ is then diverted from switch 9 to the commutation circuit. For the assumed direction of load current $I_0$ shown in FIG. 1, this diverted current, $I_{02}$, flows via $D_1$, $C_1$, L, $SCR_1$ and $D_3$. Thus $I_5$, the current through the commutation circuit, includes the diverted current. The current through the individual diodes of the bridge rectifier is:

$$I_1 = I_4 = \tfrac{1}{2}(I_5 + I_{02}), \text{ and} \tag{4}$$

$$I_2 = I_3 = \tfrac{1}{2}(I_5 - I_{02}) \tag{5}$$

The potential drop across terminals A-B, $V_{AB}$, is a function of the ratio of $I_1/I_2$ or of $I_4/I_3$. The voltage presented across terminals A-B is approximately:

$$V_{AB} \approx K_1 \ln(i_1/I_2) + K_2(I_1 - I_2) \tag{6}$$

where $K_1$ and $K_2$ represent constants based on c1rcuit parameters. Accordingly, $$V_{AB} \approx K_1 \ln\left[\frac{\tfrac{1}{2}(I_5 + I_{02})}{\tfrac{1}{2}(I_5 - I_{02})}\right] + K_2(I_1 - I_2) \approx K_1 \ln\left[\frac{(I_5 + I_{02})}{(I_5 - I_{02})}\right] + K_2 I_{02} \tag{7}$$

The apparent resistance, $R_{AB}$, is approximately:

$$R_{AB} \approx \frac{V_{AB}}{I_{02}} \approx \frac{K_1 \ln \dfrac{(I_5 + I_{02})}{(I_5 - I_{02})}}{I_{02}} + K_2 \tag{8}$$

In an exemplary embodiment using matched pairs of A390 diodes, $K_1 = 0.026$ and $K_2$, which is a function of the equivalent resistance of the particular diodes, =0.308 milliohms. Assuming an instantaneous diverted current, $I_{02} = 1000$ amperes and an instantaneous current in the commutation circuit, $I_{05} = 1500$ amperes, the voltage $V_{AB}$, based on equation (7) is approximately:

$$V_{AB} \approx .026 \ln \frac{(1500 + 1000)}{(1500 - 1000)} + .308 \times 10^{-3} \times 1000$$

$$V_{AB} \approx (.026 \times 1.61) + .308 \approx 0.35 \text{ volts}$$

The apparent resistance, $R_{AB}$, based on equation (8) is approximately:

$$R_{AB} \approx \frac{0.35}{1000} \approx 350 \text{ micro ohms}$$

The preceding value of $R_{AB}$ is an approximation that is derived from equations (6) and (8). A more precise value of $R_{AB}$ may be derived from the equation provided by a diode manufacturer for the voltage drop in the foreward direction of a conducting diode. For example, the following formula is from the "Electronic Data Library-Thyristor Rectifiers", Publication 400.5, 6-82, page 114, General Electric Company, Semiconductor Products Department, Auburn, N.Y.:

$$V_F = A + B \ln I + CI + D\sqrt{I} \tag{9}$$

Constants for the A390 diode rectifier used in the preferred embodiment are stated to be A=−0.1115; B=0.2392; C=.0005; D=−.0244. Equations (4) and (5)

specify the current through diodes 1 and 2, respectively. In the exemplary embodiment $I_5=1500$ amperes and $I_{02}=1000$ amperes. Thus, $I_1=\frac{1}{2}(1500+1000)=1250$ amperes and $I_2=\frac{1}{2}(1500-1000)=250$ amperes. The following forward voltage drops for diodes 1 and 2 result from solving equation (9) with the preceding values of constants and currents: $V_{F1}=1.357$ volts and $V_{F2}=0.949$ volts. The apparent resistance across terminals A-B is $$R_{AB}=\frac{V_{F1}-V_{F2}}{1000} \tag{10}$$

$$R_{AB}=\frac{1.357-.949}{1000}=\frac{.408}{1000}=408 \text{ microhms}$$

This confirms that the previously derived approximate value of $R_{AB}\approx 350$ micro ohms, and thus also the approximated value of $V_{AB}\approx 0.35$ volts, should be reasonably accurate. The preceding description also confirms that the potential drop, $V_{AB}$, across the inputs of the bridge rectifier is low with respect to the rated forward voltage drops of the solid state devices of the commutation network. Specifically. $V_{AB}$ is much lower than the sum of the rated forward voltage drops of the serially connected solid state devices of the commutation circuit, i.e., those traversed by the diverted load current. Indeed, $V_{AB}$ is shown to be smaller than even the forward voltage drop across the PN junction of a single solid state device, i.e., an A390 diode. The calculated value of $V_{AB}$ for a load current of 1000 amperes is 0.35 volts, whereas the rated forward voltage drop of a single A390 diode is 1.357 volts at 1250 amperes and 0.949 volts at 250 amperes. Thus, for a load current of 1000 amperes, $V_{AB}$ is less than the forward voltage drop across the serially connected solid state devices of the network, as rated at the magnitude of the diverted load current.

The voltage $V_{AB}$ and the apparent resistance $R_{AB}$ thus remain extremely low despite increasing values of diverted current $I_{02}$. This applies if the value of $I_5$ exceeds that of $I_{02}$, i.e., while $I_5$ includes a component of current produced by the commutation circuit itself. If $I_5$ consists solely of the diverted current, i.e., $I_5=I_{02}$, diodes $D_2$ and $D_3$ are backbiased. This unbalances the bridge circuit such that $R_{AB}$ *and* $V_{AB}$ tend to increase.

The subject invention can be used without the controlled impedance circuit 31. However, as explained below, use of circuit 31 improves operation and is recommended. The following description assumes that impedance circuit 31 is not used. Current diversion is then completed after switch 9 commences to open. As the switch contact force is relaxed, the contact resistance of the switch increases very rapidly with increased current diversion. However. current diversion is not solely a function of the ratio of the switch contact resistance to the apparent resistance, $R_{AB}$. The switch circuit has an inherent inductance which stores energy at the load current magnitudes that are likely to be utilized. This energy must be rapidly transferred from the switch circuit to the bridge rectifier circuit to terminate current through the switch contacts. The inherent inductance and resistance of the switch circuit is connected across terminals A-B and is thus effectively in parallel with the inherent inductance and resistance of conductors 19, 20 and the bridge rectifier 21. The time constant of this circuit is comparatively long, being proportional to the ratio of the inherent inductance to the inherent resistance. A potential must therefore be applied in the switch circuit to transfer the stored energy. This occurs inherently because of the voltage produced across the opening switch contacts. Stored energy is transferred at a rate proportional to the ratio of the magnitude of this potential to the inductance. As the contacts open, the voltage, and thus the rate of stored energy transfer, increases rapidly. Thus, the stored energy is transferred at a finite time after contact opening. However, during this time, the voltage may be sufficient to create an arc and plasma could produce some contact pitting.

Use of the controlled impedance circuit 31 prevents this undesirable phenomena. As described in the referenced U.S. Pat. No. 4,636,907, the controlled impedance 31 introduces a voltage in the switch circuit prior to switch opening and thus permits the switch to be opened after the load current has been entirely transferred. The magnitude of this voltage determines the rate at which the above referenced stored energy is transferred:

$$V_{31}\approx L\frac{di}{dt} \tag{9}$$

where $V_{31}$ is the potential drop across impedance 31, L is the inherent inductance in the switch and bridge rectifier circuit and di/dt is the rate at which current is transferred from the switch circuit. Assuming that 1000 amps must be transferred in 10 microseconds (i.e., 100 amps/microsecond) and that the inherent inductance is 0.1 microhenries:

$$V_{31}\approx(10^8 \text{ amperes/second})(10^{-7} \text{ henries})$$

$$V_{31}\approx 10 \text{ volts}$$

Thus, for this example, the controlled impedance should, upon initiation, produce a voltage drop of 10 volts in series with the switch.

Figures 6B, 6C, 6D:
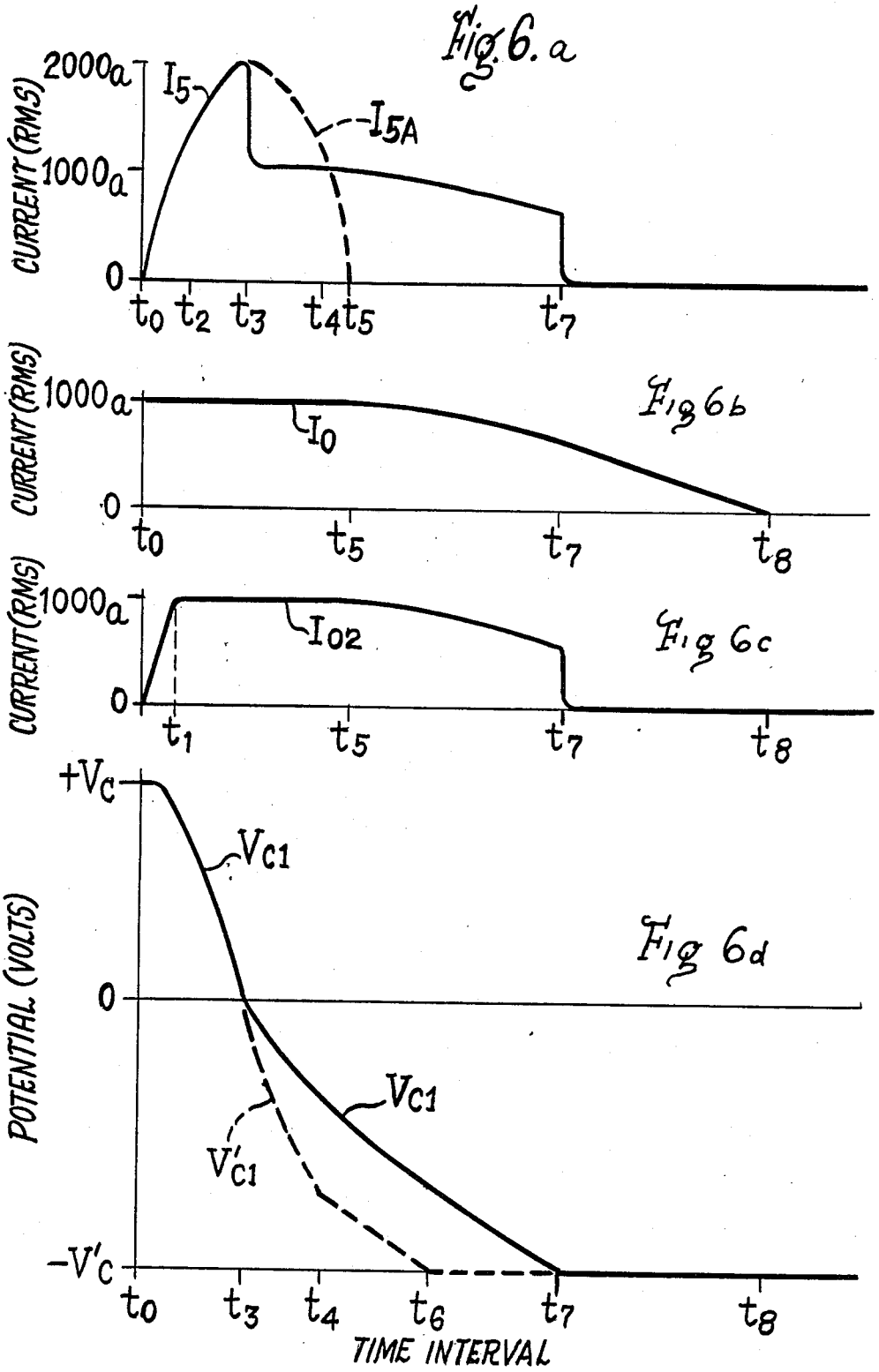

Reference is again directed to FIG. 6 for a further explanation of current diversion and switch opening in the circuit of FIG. 1, which includes controlled impedance circuit 31. As previously explained, switch opening is activated at $t_0$ by initiating commutation current flow. The controlled impedance circuit is simultaneously activated at $t_0$. FIG. 6c illustrates the magnitude of the diverted current, $I_{02}$. Diversion commences immediately at $t_0$ and is rapidly completed with $I_{02}=I_0$ at $t_1$. Switch 9 is opened after the current in the commutation circuit $I_5$ exceeds the load current $I_{02}$ and, in this embodiment, after total diversion of the load current. FIG. 6 illustrates an example where the load current $I_0$ (FIG. 6b) and thus the totally diverted load current $I_{02}$ (FIG. 6c) are 1000 amperes. In this example, switch 9 is opened at $t_2$ when $I_5$ is 1500 amperes. As previously described, $I_5$ increases substantially sinusoidally until it attains its peak value at $t_3$, i.e., a quarter cycle from its inception at $t_0$. The value of $I_5$ at its peak is at most:

$$\text{Peak } I_5=\frac{V_C}{\sqrt{\frac{L}{C_1}}} \tag{10}$$

where $V_C$ is the voltage to which capacitor $C_1$ is initially charged by power supply 28. The peak value of $I_5$ must exceed the magnitude of $I_0$, preferably by a substantial amount. In the example illustrated in FIG. 10, the peak value of $I_5$ is 2000 amps, i.e., twice the value of $I_0$. The parameters of the commutation circuit, and particularly of L, $C_1$ and the potential of the power supply, are selected to provide the appropriate peak current value. They must further be selected, with reference to equation (2), so that the time interval $t_0$–$t_3$ is sufficient to assure full load current diversion and sufficient opening of the switch to prevent subsequent switch breakdown or reignition. With an appropriate switch, such as the one disclosed in above referenced U.S. Pat. No. 4,644,309, this can be accomplished very rapidly. A preferred embodiment successfully switched load currents in the range specified above in less than 100 microseconds. Thus, diversion occurs almost instantaneously. This is of particular value in overload current protection systems. Interruption can commence when the load current exceeds its normal value by a predetermined amount. Even under short circuit conditions, the overload current increases at a relatively low rate with respect to the time required to interrupt current flow, $t_0$–$t_3$. Thus, interruption is complete before short circuit currents can even attain the peak value of $I_5$.

The above described example assumed that the peak value of $I_5$ is 2000 amperes and that load current interruption is commanded when the load current $I_0$ is 1000 amperes. Interruption can, of course, occur at other values of load current $I_0$, to the extent that $I_0$ is substantially below the selected peak value of the commutation current $I_5$. In a system that interrupts responsive to a predetermined value of load current, the value of the latter can thus be easily varied. Control circuit 29 can be designed to generate interruption signals at any selected value of load current that is below a predetermined maximum value.

Figure 6E:
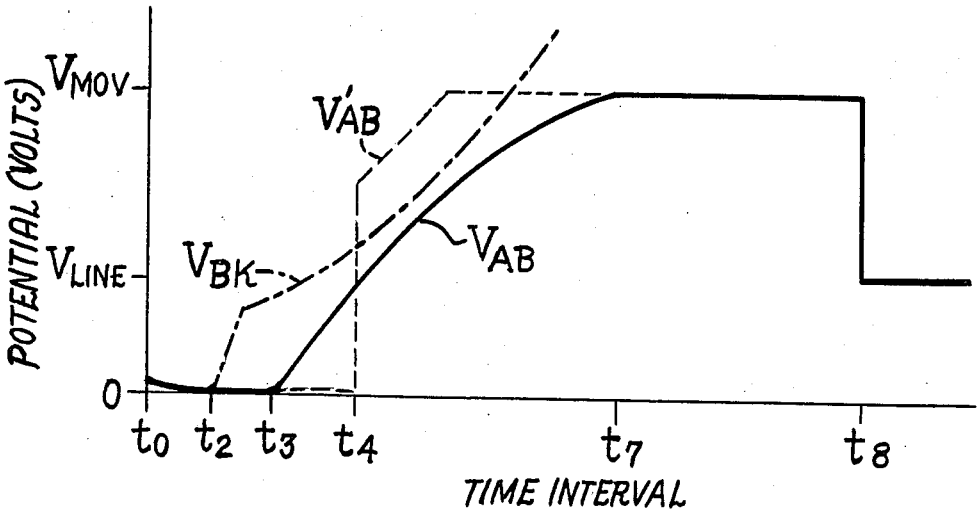

The above description of FIG. 6 has been directed to the current waveforms. FIG. 6*d* illustrates the potential across capacitor $C_1$. During the interval $t_0$–$t_3$, i.e., during the first quarter cycle, this voltage characteristically decreases sinusoidally from $V_C$ to zero, leading current $I_5$ by 90 degrees. FIG. 6*e* illustrates the potential $V_{AB}$ which, because of the balanced rectifier bridge, is near zero volts during the interval $t_0$–$t_3$.

Thus, at the conclusion of the first quarter cycle, at $t_3$ load current has been entirely diverted through the commutation circuit, switch 9 has opened sufficiently to prevent subsequent breakdown, and the commutation circuit essentially applies a zero voltage across the switch.

Subsequent to time $t_3$, the voltage across terminals A-B, and thus across switch 9, is increased to the potential at which the voltage responsive device, i.e., MOV 18, conducts. As shown in FIG. 6*e*, this potential, $V_{MOV}$, substantially exceeds the line voltage, $V_{LINE}$, that normally appears across the open switch. The voltage across terminals A-B, $V_{AB}$, should be increased at a controlled rate as, for example, indicated by the solid line identified as $V_{AB}$ in FIG. 6*e*. Otherwise, if the amplitude of $V_{AB}$ is raised suddenly prior to the switch contacts having fully opened, switch 9 could breakdown and resume conduction. The dashed-dot line labeled $V_{BK}$ in FIG. 6*e* illustrates the breakdown potential, $V_{BK}$, of one type of switch. Voltage $V_{AB}$ is thus ramped so that its amplitude does not at any time attain the level of $V_{BK}$. Specifically $V_{AB}$ increases from substantially zero volts at $t_3$ and rises to the conduction potential, $V_{MOV}$, of MOV 18 at $t_7$. During time interval $t_3$–$t_7$, conduction of the diverted line current $I_{02}$ continues through the commutation circuit, diminishing as the voltage $V_{AB}$ rises.

The following explains how voltage $V_{AB}$ is increased in accordance with the above stated requirements. The purpose of diode $D_5$ can best be understood by initially considering circuit operation without $D_5$. Without the diverted current $I_{02}$, the commutation circuit would initially perform essentially as a series L-C circuit. During the second quarter cycle, i.e., during the interval $t_3$–$t_5$, the current through capacitor $C_1$, and thus through inductor $L_1$, would sinusoidally descend from its peak value at $t_3$ to zero at $t_5$ as shown by the dashed line labeled $I_{5A}$ of FIG. 6*a*. However, because of the presence of diverted load current, the current in the commutation circuit decreases sinusoidally only until it attains, at $t_4$, the magnitude of the diverted current $I_{02}=I_0$. Subsequent to $t_4$ (and until $t_7$) the current in the commutation circuit remains approximately at the amplitude of the diverted current. Thus, without diode $D_5$ during the time interval $t_3$–$t_4$, the current in the commutation circuit exceeds the value of the diverted current and the voltage across terminals A-B remains close to zero. Subsequent to $t_4$, the current in the commutation circuit consists solely of the diverted current. As previously explained, this unbalances the bridge rectifier and thus increases the voltage across terminals A-B. As shown by the dashed line labeled $V'_{AB}$ of FIG. 6*e*, there is a stepped voltage increase at $t_4$. This can best be understood by considering the voltage across capacitor $C_1$ illustrated by the dashed line $V'_{C1}$ of FIG. 6*d*. The capacitor voltage descends through zero at $t_3$ and, because of the sinusoidal current in the commutation circuit, sinusoidally increases to a substantial magnitude at $t_4$. The rate-of-change of the sinusoidal current produces a voltage across inductor L equal to the voltage across capacitor $C_1$. When $I_5$ decreases to the value of $I_{02}$, the current becomes essentially constant, the rate-of-change becomes very small, hence, the voltage across inductor L also becomes very small. Thus, the capacitor potential suddenly appears across terminals A-B at $t_4$, causing the stepped increase of $V'_{AB}$. As shown in FIG. 6*e*, $V'_{AB}$ can thus exceed the switch breakdown potential $V_{BK}$ and cause the breakdown and further conduction of switch 9.

Figure 6F:
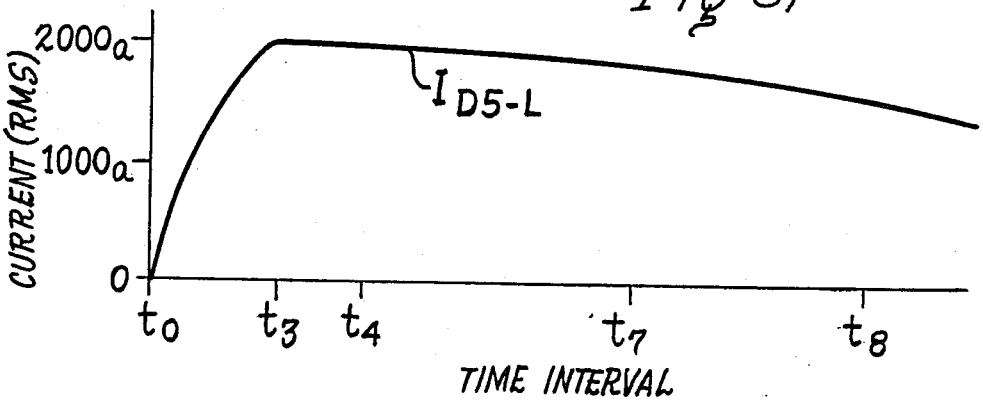

Additional means can be used to adequately control, i.e., reduce, the rate at which the voltage across terminals A-B, and thus across switch 12, is increased. In the preferred embodiment of FIG. 1, this voltage control is accomplished by diode $D_5$ connected across inductor L. $D_5$ is poled to block conduction and thus has no effect during the interval $t_0$–$t_3$. However, at $t_3$, when the capacitor voltage descends through zero, $D_5$ commences conduction so that a current representative of the peak value of $I_5$ circulates in the loop comprising $D_5$ and inductor L. This loop circuit has a long time constant corresponding to L divided by the inherent resistance of the loop circuit. The slowly descending loop current, $I_{D5\text{-}L}$, is illustrated in FIG. 6*f*. At $t_3$, loop current conduction produces a rapid reduction of current $I_5$ from the peak value of $I_5$ to the value of the diverted current $I_{02}$. $I_5$ subsequently, i.e., at $t_3$, equals $I_{02}$ and thus remains relatively constant from $t_3$ *to* $t_7$ as shown by solid line $I_5$ of FIG. 6*a*. When $I_5=I_{02}$ at $t_3$, the bridge rectifier becomes unbalanced such that the voltage across terminals A-B, $V_{AB}$, *becomes a function of the voltage across the capacitor* $C_1$. The relatively constant current $I_5$ charges capacitor $C_1$ so that the capacitor voltage increases approximately linearly. This is shown by the solid line labeled $V_{C1}$ of FIG. 6*d*. $V_{AB}$ thus also increases approximately linearly, such that its amplitude remains well below the permissable breakdown voltage. This is shown by the solid line labeled $V_{AB}$ in FIG. 6*e*.

The waveforms shown in FIG. 6 are based on the assumption that the load current $I_0$ remains relatively constant until $t_3$. As $V_{AB}$ increases above the magnitude of $V_{LINE}$, the values of $I_0$, $I_{02}$ and $I_5$ decrease gradually as shown in FIGS. 6*a*, *b* and *c*. However, with inductance in the power line circuit, if interruption occurs as the load current increases, the value of currents $I_0$ *and* $I_{02}$ may increase until $V_{AB}=V_{LINE}$ and decrease thereafter.

The voltage responsive device 18 conducts at $t_7$ when $V_{AB}$ increases to its conduction voltage, $V_{MOV}$. Remaining current, $I_0$, from the switch circuit is now entirely diverted by device 18 so that no further switch current, $I_{02}$ and $I_5$, appears in the commutation circuit, as shown in FIGS. 6*a* and 6*c*. Conduction of device 18 continues until the remnant of the current in the switch circuit has been entirely dissipated at $t_8$, as shown in FIG. 6*b*. At this time, the voltage across terminals A-B corresponds to the line voltage, $V_{LINE}$, that appears across the open switch.

With source inductance, capacitor $C_1$ can charge to a value representative of twice the line voltage at interruption plus a voltage produced by the current stored in the source inductance at interruption. The maximum voltage on capacitor $C_1$ thus is a function of the inductance and the diverted load current. The waveforms of FIG. 6 are, of course, based on the assumption that capacitor $C_1$ will be charged to a voltage exceeding the clamping voltage $V_{MOV}$ of the voltage dependent device 18. The clamping voltage should preferably be at least twice the line voltage to assure that the diverted current decays at a sufficient rate. Device 18 limits, i.e., clamps, the maximum voltage across the commutating circuit to a value below the maximum attainable capacitor voltage. This assures that this maximum voltage does not exceed the blocking voltage of the solid state devices of the commutating circuit, primarily that of $SCR_1$, but also of diodes 1–4, and that it does not exceed the maximum voltage that can be applied to the power line load circuits. Since device 18 diverts a portion of the load current from the commutation circuit, its presence may also diminish heat rise in the SCR.

However, the voltage dependent device 18 may not be required in some applications. This includes situations where the line voltage, inductance and/or stored energy are sufficiently low so that the maximum voltage attainable on capacitor $C_1$ is not excessive and load current can be entirely diverted in the commutation circuit. If device 18 is eliminated, it may be desirable to increase the value of capacitor $C_1$ to limit the voltage rise. However, this increases the time required to reduce diverted current to zero and, of course, affects the previously described parameters of the L-C commutation circuit.

At the conclusion of current diversion, capacitor $C_1$ discharges via the series circuit of resistor $R_1$ and power supply 28. The time constant of this circuit should permit discharging capacitor $C_1$ and recharging it prior to the next interruption event, while being sufficiently great so as not to adversely affect operation of the commutation circuit.

As is evident from the above description, the arrangement of FIG. 1 provides automatic and extremely rapid interruption of a-c or d-c currents, including those of very large magnitude, e.g., in the range of thousands of amperes. Interruption can be accomplished selectively with no or with minimal contact arcing so as to prolong switch and contact life. This can be achieved with small, high speed switching devices that do not require the normally utilized arrangements for arc containment and extinction.

Various alternative embodiments are hereinafter described. The schematics of the following alternative embodiments omit some control lines and omit designations of currents.

Figure 2:
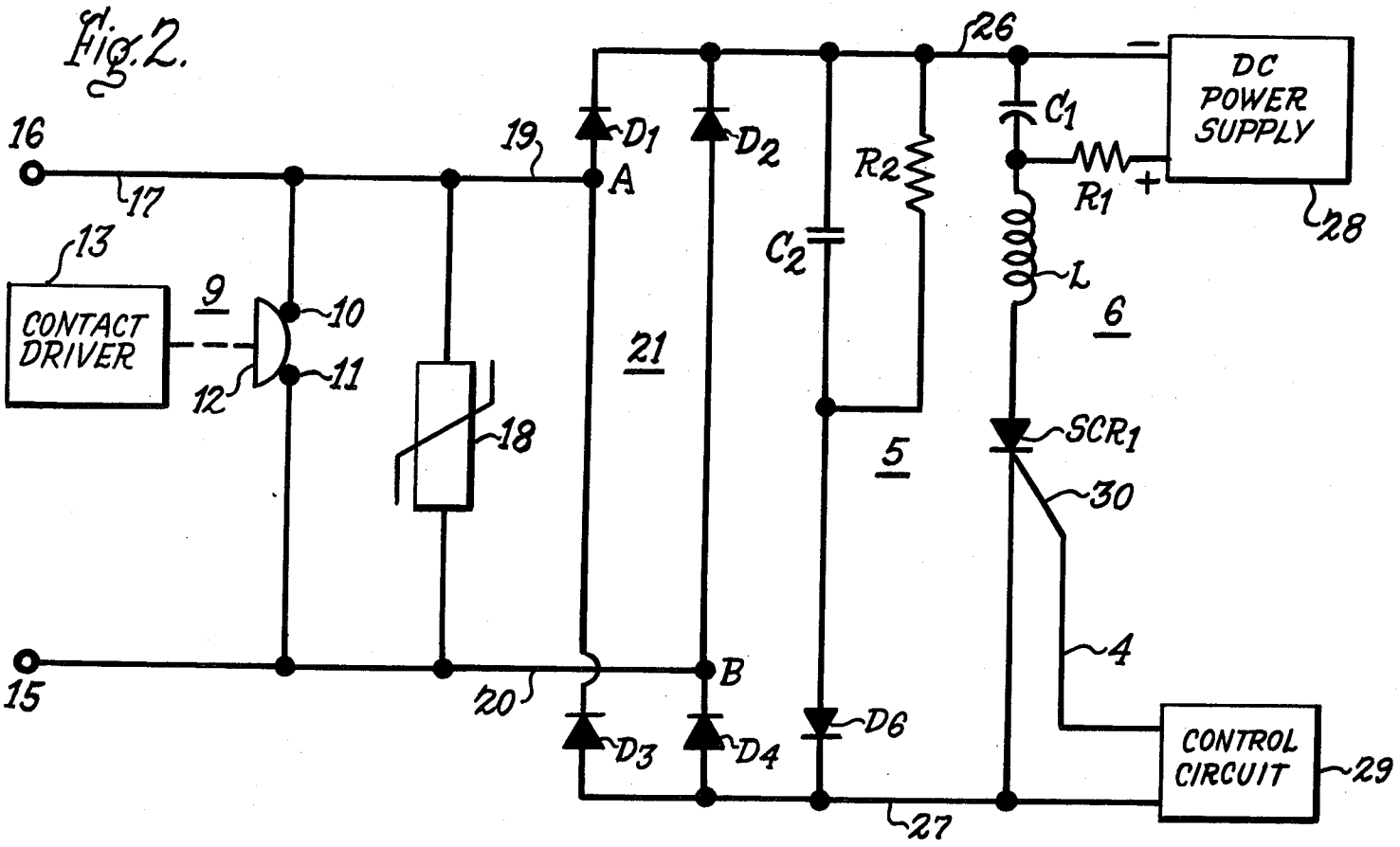
FIG. 2 is a schematic representation of an alternative embodiment utilizing an alternative voltage control circuit.

FIG. 2 illustrates an alternative arrangement that differs from the preferred embodiment of FIG. 1 by omitting the controlled impedance circuit 31, and also by substituting an alternative form of voltage control means to limit the rate of increase of the voltage across the input of bridge rectifier 21.

In the preferred embodiment of FIG. 1, switching means 9 and circuit 31 are serially connected between terminals 15 and 16. As previously explained, circuit 31 improves performance. Although its use is preferred, it is not essential. It is not included in the arrangement of FIG. 2. Switching means 9 is instead connected directly between terminals 15 and 16.

FIG. 1 illustrates diode $D_5$ connected across inductor L. This is the preferred voltage control means for limiting the rate of increase of the voltage across the input of bridge rectifier 21. The embodiment of FIG. 2 excludes $D_5$ and instead utilizes an alternative voltage control means comprising capacitor $C_2$, resistor $R_2$ and, preferably also, unilaterally conducting means, i.e., diode $D_6$. Capacitor $C_2$ and unilaterally conducting means, i.e., diode $D_6$, are connected in series across the output of the rectifier bridge, i.e., across lines 26 and 27. Diode $D_6$ has its anode connected to capacitor $C_2$ and its cathode connected to line 27. Resistor $R_2$ is connected across capacitor $C_2$.

This circuit is best understood by reviewing operation of the commutation network. The current pulse, produced by discharge of capacitor $C_1$, initially maintains the voltage of the bridge rectifier output at a very low value. Subsequently, this value increases. Without any voltage control means, the bridge voltage could suddenly increase sufficiently to break down the switching means. This undesirable voltage jump (shown by $V'_{AB}$ at $t_4$ in FIG. 6*e*) can occur when the commutation current decreases to the magnitude of the diverted current $I_{02}$ (as shown by $I_{5A}$ at $t_4$ in FIG. 6*a*). Capacitor $C_2$, being essentially in parallel with the bridge output, limits the rate of rise of the bridge voltage and thus prevents breakdown of the switching means. The capacitance of $C_2$ may therefore be relatively high. Diode $D_6$ is poled to prevent capacitor $C_2$ from being charged by the current pulse produced by discharge of $C_1$. $D_6$ thus prevents capacitor $C_2$ from delaying the initiation of current diversion from the switching means.

When a load current interruption command discharges capacitor $C_1$, the voltage across bridge input terminals A-B drops to almost zero voltage. The voltage across the bridge output, i.e., across lines 26–27, is then at a somewhat higher value, e.g., 3 volts, representative of the forward voltage drops across the two serially connected diodes of the bridge ($D_1$–$D_3$ or $D_2$–$D_4$). Line 27 is initially positive and line 26 is initially negative. Absent diode $D_6$, discharged capacitor $C_2$ would first be charged to the potential across lines 26–27 by the current pulse produced by the discharge of capacitor $C_1$. This delays the appearance of the low apparent resistance across the input terminals of the bridge and thus delays current diversion to the commutation network. The value of the current pulse subsequently decreases below the value of the diverted current, i.e., $I_5 = I_{02}$. At about this time ($t_4$ of FIG. 6*e*), the voltage between lines 26 and 27 reverses. Capacitor $C_2$ then charges to this reversed potential across the output of the bridge rectifier so as to limit the rate of rise of the voltage across the bridge and to prevent breakdown of the switching means. With diode $D_6$ in the circuit, capacitor $C_2$ remains discharged until the value of the current pulse decreases below the value of the diverted current. Thus, use of diode $D_6$ is preferred since it does not delay current diversion. Upon termination of current flow in the commutation network 5, capacitor $C_2$ discharges via resistor $R_2$. In the preferred embodiment, resistor $R_2$ essentially shunts the switching means 9, and d-c power supply 28 shunts capacitor $C_2$. Therefore, the values of resistors $R_2$ and $R_1$ should be sufficiently high to prevent undesirable effects. Some modifications may be made of the above described circuit. For example, the single resistor $R_2$ may be replaced with a first resistor across lines 26–27 and a second resistor across diode $D_6$. Timed switching circuits might be used to charge capacitor $C_1$ and to discharge $C_2$. Also, diode $D_6$ may not be required in all applications.

Figure 3:
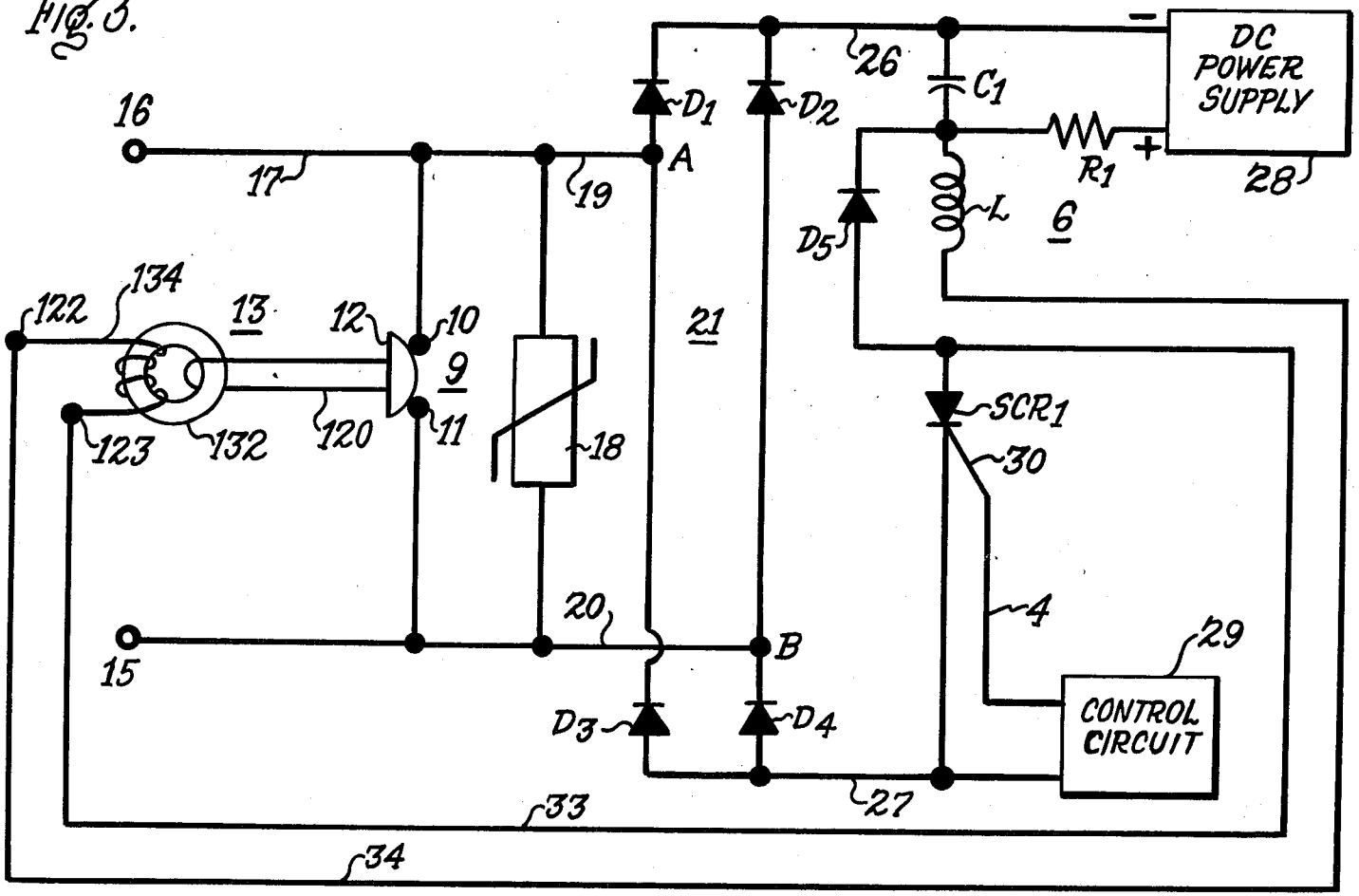
FIG. 3 is a schematic representation of an alternative embodiment wherein the pulse current in the commutation network is used to open the switching means.

FIG. 3 schematically illustrates an alternative arrangement for opening switching means 9 responsive to the pulse current flow in the commutation network instead of being actuated by control circuit 29. Switching means 9 is of the type disclosed in referenced U.S. Pat. No. 4,644,309. It comprises a bridging contact 12 that is rapidly displaced from switching means terminals 10 and 11 by operation of the contact driver 13. The latter comprises conductor 120, torroidal core 132, winding 134 and input terminals 122 and 123. Conductor 120 is arranged as a closed loop with the bridging contact and is looped about torroidal core 132. The parallel adjacent portions of conductor 120 are preferably arranged within a magnetic structure (not shown). Winding 134 extends about core 132 and terminates at terminals 122 and 123. As described in the referenced application, application of a current pulse to terminals 122 and 123 results in current flow in the loop comprising conductor 120 and bridge contact 12. This current produces electromagnetic displacement of the adjacent parallel portions of conductor 120 and thus a rapid disengagement of bridging contact 12 from switching means terminals 10 and 11. Winding 134 is shown as being connected in series circuit with inductor L and unilaterally conducting means $SCR_1$. Specifically, winding 134 is connected from terminal 122 via line 34 to inductor L, and from terminal 123 via line 33 to the anode of $SCR_1$. Voltage control means $D_5$ is connected across the series combination of inductor L and winding 134. Inductor L and contact driver 13 should be designed so that bridging contact 12 does not open until the pulse current attains a magnitude that exceeds the value of the load current at the time of interruption.

Figure 4:
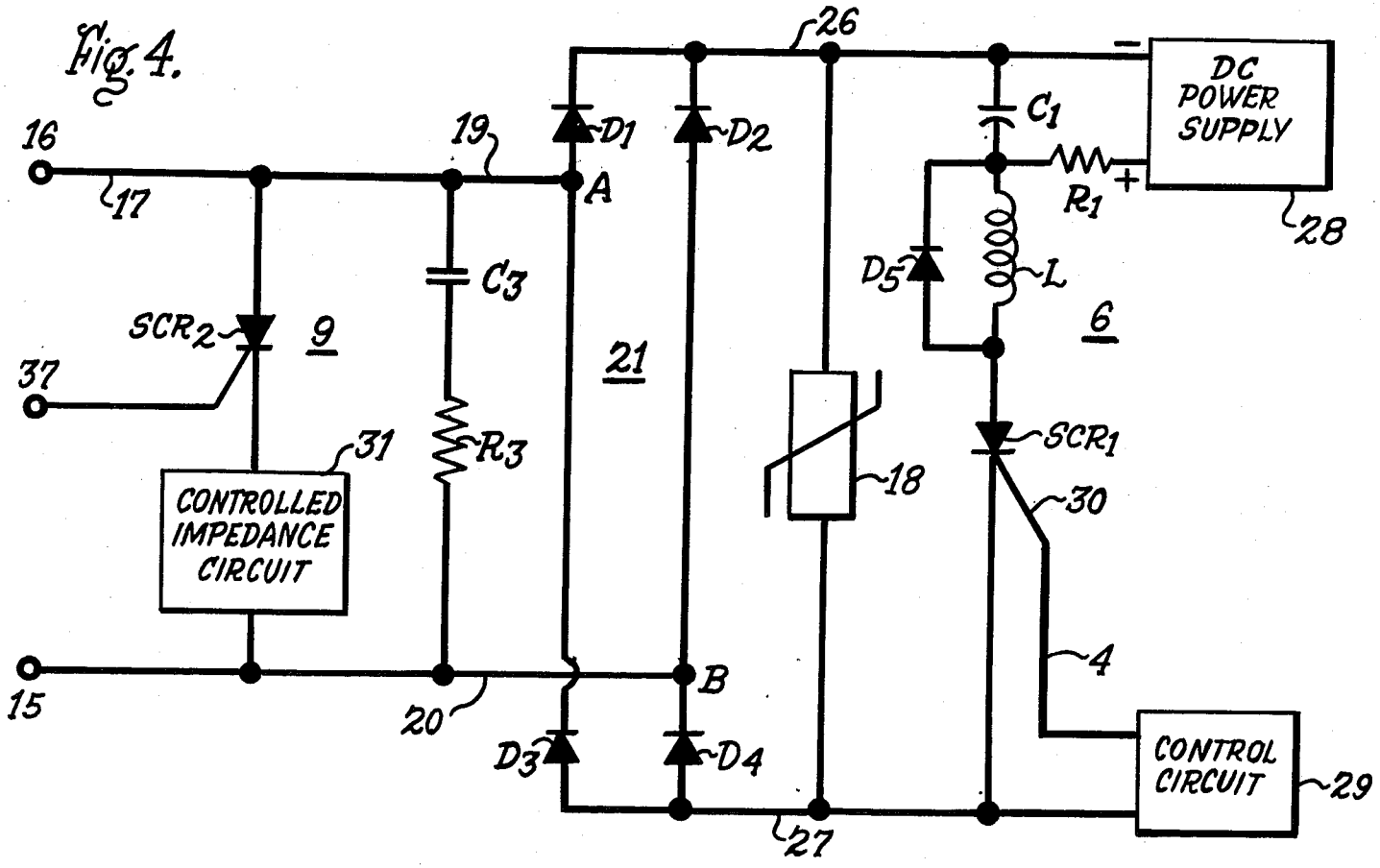
FIG. 4 is a schematic representation of an alternative embodiment utilizing a thyristor device as the switching means and illustrating an alternative connection of the voltage responsive means.

FIG. 4 illustrates an alternative arrangement wherein the switching means 9 comprises solid state switching means in lieu of electromechanical switching means. In this embodiment, the switching means comprises thyristor $SCR_2$. The main electrodes of $SCR_2$ are shown as being connected in series with controlled impedance circuit 31 between load terminals 15 and 16. In the circuit of FIG. 4, the anode is connected to line 16 and the cathode is connected via circuit 31 to line 15 so that load current flows through $SCR_2$ and the controlled impedance circuit 31. The latter circuit 31 is not required, but is desirable since it provides more rapid load current diversion. As previously described, the load current interruption signal drastically reduces the apparent resistance across the input of bridge rectifier A-B. This diverts load current from $SCR_2$ to the commutation network. The anode current of $SCR_2$ is thus reduced below the holding current level of thyristor $SCR_2$ causing the thyristor to be switched to the foreward blocking state, i.e., to be cut off. The load current interruption signal also increases the impedance value of controlled impedance circuit 31 so as to expedite load current diversion to the commutation network and thus to also expedite turn off of $SCR_2$. Turn off commutation thus results automatically from the very low voltage applied from the input of the bridge A-B via lines 19–20. across the circuit including the anodecathode electrodes of the thyristor. This low voltage occurs in the time interval $t_0$–$t_3$, as shown by line $V_{AB}$ in FIG. 6*e*. Thus, the solid state switching means need not be of the gate turn off variety.

FIG. 4 further illustrates a snubber network comprising capacitor $C_3$ and resistor $R_3$ connected serially across the bridge input lines 19 and 20. The use of such RC snubbers with solid state networks, such as diode bridges, is well known. Diodes of the bridge rectifier, e.g., $D_2$ and $D_3$, are subjected to a reverse voltage which can cause a reverse recovery current transient and thus produce undesirable effects on $SCR_2$. The series connected resistor $R_3$ and capacitor $C_3$ limits the rate of change of the voltage applied across $SCR_2$.

In FIG. 4, the voltage responsive device 18 is shown as connected across lines 26 and 27. It is thus on the output instead of the input side of the bridge. This is satisfactory although placement on the input side as shown in FIG. 1 is preferred.

Figure 5:
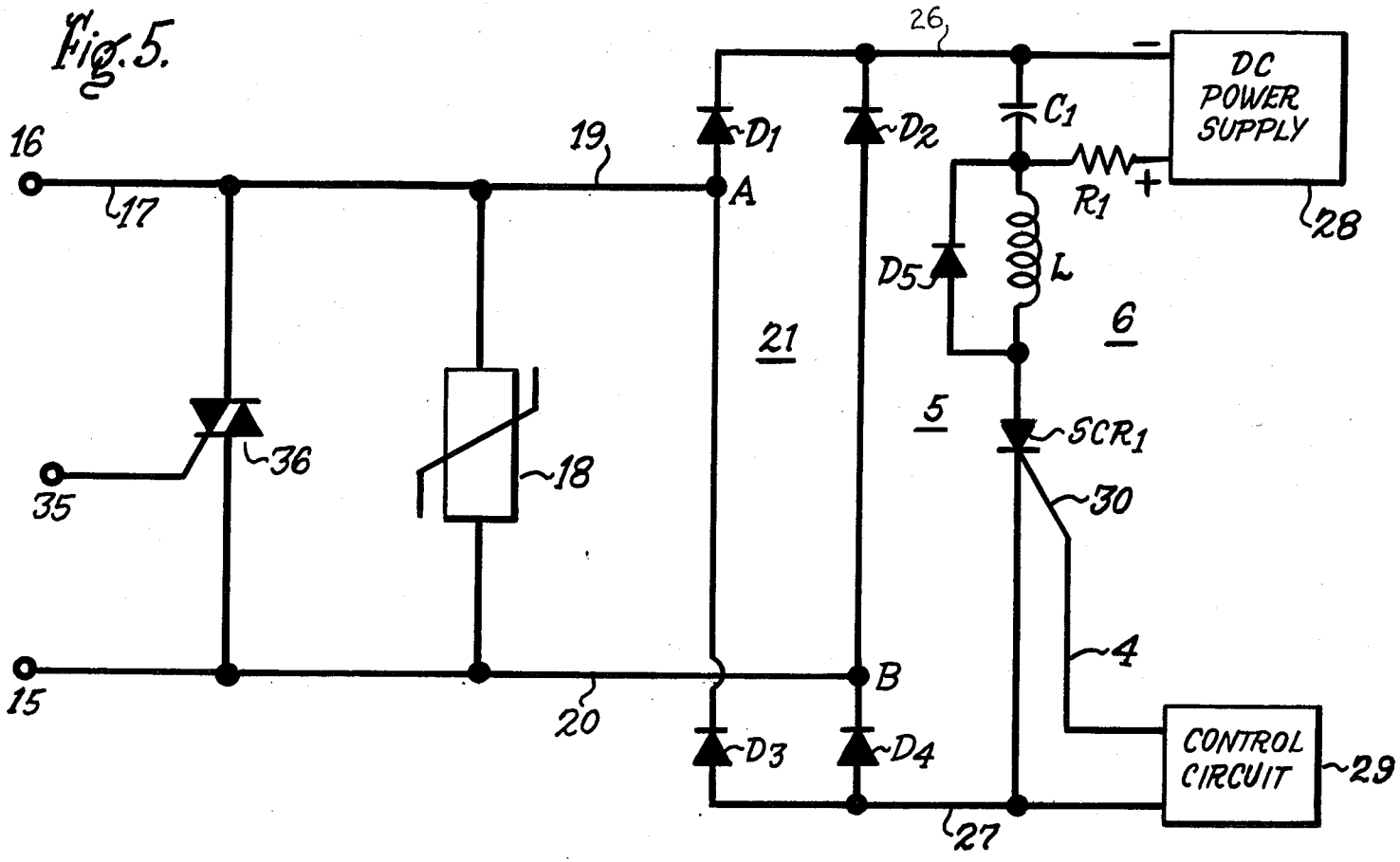
FIG. 5 is a schematic representation of an alternative embodiment utilizing a bilaterally conductive solid state device as a switching means.

FIG. 5 illustrates another alternative wherein a bilaterally conducting solid state device, i.e., a triac 36, is utilized. The main electrodes are connected to load terminals 15 and 16, and the device is gated on via terminal 35, similar to the arrangement of FIG. 4. Such a bilaterally conducting solid state switch is, of course, preferable to the unilaterally conducting device of FIG. 4, in circuits energized by an alternating current power source. Alternative bilaterally conductive solid state devices, such as back to back connected thyristors, may of course be utilized. As noted with reference to the circuit of FIG. 4, current diversion may be expedited by adding a controlled impedance circuit in series with the solid state device.

It should be apparent to those skilled in the art that additional changes may be made in the disclosed embodiments without departing from the true spirit and scope of the invention.

What I claim as new and desire to secure by Letters Patent of the United States is:

1. A circuit interrupter for interrupting load current flow in a power line connecting a source of electric power to a load, comprising:

(a) a bridge rectifier having input terminals and output terminals;

(b) pulse forming means connected in circuit with the output terminals of said bridge rectifier to form a closed loop network;

(c) said pulse forming means, responsive to a load current interruption signal, supplying through said network a current pulse having a peak magnitude greater than the magnitude of the load current;

(d) switching means connected in series circuit with a power line;

(e) the input terminals of said bridge rectifier being connected in circuit with said switching means so that responsive to the current pulse the apparent resistance across said input terminals is switched from a high to a very low value and load current is diverted from the switching means to the closed loop network; and (f) said switching means being constructed to permit its being opened to interrupt load current flow therethrough subsequent to the initiation of load current diversion to the closed loop network.

2. The circuit interrupter of claim 1 wherein the pulse forming network supplies a current pulse, through said closed loop network, having a time-current relationship such that upon diversion of the load current through the network, the voltage across the input terminals of said bridge rectifier is increased from an extremely low value to a substantially higher value.

3. The circuit interrupter of claim 2 wherein said pulse forming network comprises capacitance means and inductance means connected in series circuit with the output terminals of said bridge rectifier, and charging means for charging said capacitance means and discharge means response to the current interruption signal for discharging the charged capacitance means through the aforesaid series circuit to form the current pulse.

4. The circuit interrupter of claim 3 further comprising voltage control means to limit the rate of increase of the voltage across the input terminals of said bridge rectifier to prevent further conduction of the switching means upon its opening.

5. The circuit interrupter of claim 4 wherein said voltage control means comprises first unilaterally conducting means connected in parallel circuit with said inductance means and poled to block conduction of the current pulse but to thereafter support current conduction in a loop circuit comprising said inductance means and said first unilaterally conducting means.

6. The circuit interrupter of claim 4 wherein said voltage control means comprises second capacitance means connected in parallel circuit with said bridge rectifier so as to be charged by the load current diverted from the switching means to the closed loop network.

7. The circuit interrupter of claim 6 wherein said voltage control means further comprises resistance means for discharging said second capacitance means, and second unilaterally conducting means connected in series circuit with said second capacitance means and poled to prevent said last named means from being charged by the current pulse produced by said pulse forming means.

8. The circuit interrupter of any of claims 1 to 7 wherein said switching means comprises separable contacts and means for separating said contacts in response to an electric signal.

9. The circuit interrupter of claim 8 further comprising signal means for generating the electric signal to separate said contacts subsequent to said current pulse having attained a value of current exceeding that of the load current.

10. The circuit interrupter of claim 9 wherein said signal means generates the electric signal responsive to current flow in said closed loop network.

11. The circuit interrupter of any of claims 1 to 7 wherein said switching means comprises solid state switching means and said last named means is commutated off responsive to the apparent resistance across the input terminals of the bridge rectifier being switched to a very low value.

12. The circuit interrupter of any of claims 2 to 7 further comprising voltage dependent conduction means connected in parallel circuit with said switching means and with said bridge rectifier to divert from said network remnant portions of the diverted load current upon the voltage across the input terminals of said rectifier bridge increasing to a predetermined value that exceeds the line voltage that appears across said switching means subsequent to its being opened.

13. The circuit interrupter of any of claims 1 to 7 further comprising controlled impedance means connected in series circuit with said switching means and wherein the input terminals of said bridge rectifier are connected across the series circuit comprising said switching means and controlled impedance means; said controlled impedance being switched from a very low impedance value to a higher impedance value responsive to the load current interrupting signal to expedite diversion of the load current.

14. The circuit interrupter of claim 13 further comprising means for opening said switching means upon the load current having been completely diverted to said network.

15. The circuit interrupter of any of claims 1 to 7 further comprising current sensing means for producing a signal representative of the value of the load current and control circuit means for generating the load current interrupting signal responsive to load current attaining a predetermined magnitude.

16. A circuit interrupter for interrupting a-c load current by switching means connected in a series circuit with a source of alternating current and a load and wherein the a-c load current is diverted to a network so that minimal arcing occurs upon the opening of the switching means, the combination comprising:

(a) switching means being adapted for connection in series circuit with the source of alternating current and the load so as to conduct a-c load current 10 to the load;

(b) a network comprising solid state circuit means and pulse means;

(c) said pulse means, responsive to a load current interruption signal, supplying said solid state means a current pulse having a peak magnitude greater than the magnitude of the load current, and a duration that is substantially less than the duration of a half cycle of the a-c load current;

(d) said solid state circuit means having inputs connected in circuit with said switching means for diverting the a-c load current from said switching means to said network during the presence of the current pulse notwithstanding the instantaneous direction of the a-c load current; and (e) said switching means being opened responsive to the load current interruption signal during the duration of the current pulse.

17. The circuit interrupter of claim 16 wherein said pulse means provides through said network a current pulse whose peak amplitude occurs substantially prior to the termination of diverted load current flow through said network so that subsequent to the occurrence of the peak amplitude, the voltage across said solid state circuit means, and thus across the switching means, is increased from a very low value to a substantially higher value.

18. The circuit interrupter of claim 17 further comprising voltage control means to limit the rate of increase of the voltage across said solid state circuit means to prevent further conduction of the switching means upon its opening.

19. The circuit interrupter of claim 17 wherein said pulse means comprises inductance means and first capacitance means connected in series circuit with said solid state circuit means, charging means for charging said first capacitance means and discharge means for discharging said first capacitance means in response to a load current interrupting signal.

20. The circuit interrupter of claim 19 wherein said discharge means comprises gated solid state means connected in series circuit with said inductance means, first capacitance means and solid state circuit means so that gating on said gated solid state means responsive to the load current interrupting signal discharges the capacitance means through the aforesaid series circuit.

21. The circuit interrupter of claim 20 wherein the inductance, capacitance and voltage values, respectively, of said inductance, first capacitance and charging means are selected such that the peak value of the current pulse exceeds the value of the load current.

22. The circuit interrupter of claim 21 further comprising voltage control means to limit the rate of increase of the voltage across said solid state circuit means to prevent further conduction of the switching means subsequent to its opening.

23. The circuit interrupter of claim 22 wherein said voltage control means comprises unilaterally conducting means connected in parallel circuit with said inductance means; said unilaterally conducting means being poled to block conduction of the current pulse but to thereafter support current conduction in a loop circuit comprising said inductance means and said unilaterally conducting means.

24. The circuit interrupter of claim 22 wherein said voltage control means comprises second capacitance means connected in a parallel circuit with said solid state circuit means so as to control the increase of the voltage across the inputs of said solid state circuit means.

25. The circuit interrupter of claim 24 further comprising second unilaterally conducting means connected in series circuit with said second capacitance means and poled to prevent charging of the aforesaid means from said first capacitance means.

26. The circuit interrupter of claim 24 further comprising resistance means for discharging said second capacitance means.

27. The circuit interrupter of claim 26 wherein the resistance value of said resistance means is sufficiently high to minimize load current diversion therethrough.

28. The circuit interrupter as in any of claims 16–27 further comprising controlled impedance means connected in series circuit with said switching means and wherein said solid state circuit means is connected in circuit with said switching means and said controlled impedance means to divert load current from said switching means to said network; responsive to said controlled impedance being switched from a very low impedance value to a higher impedance value by the load current interrupting signal.

29. The circuit interrupter as in any of claims 16 to 24 further comprising load current sensing means and control circuit means for generating the load current interrupting signal responsive to the load current attaining a predetermined magnitude.

30. The circuit interrupter as in any of claims 17 to 24 further comprising voltage dependent conduction means connected in parallel circuit with said solid state circuit means and with said switching means to divert from said network remnant portions of the diverted load current subsequent to the voltage across said solid state circuit means attaining a predetermined value that exceeds the line voltage that appears across said switching means subsequent to its being opened.

31. A circuit interrupter for interrupting load current flow in a power line, comprising:

(a) a bridge rectifier having input terminals and output terminals;

(b) capacitance means, inductance means and gated solid state means connected in series circuit with the output terminals of the bridge rectifier;

(c) charging means for charging said capacitance means;

(d) means for gating on said gated solid state means in response to a load current interruption signal for discharging said capacitance means through the aforesaid series circuit;

(e) switching means connected in series circuit with a power line;

(f) the input terminals of said bridge rectifier being connected in circuit with said switching means to divert load current from said switching means through the aforesaid series circuit; and (g) means for opening said switching means subsequent to the occurrence of the load current interruption signal.

* * * * *